United States Patent [19]

Adman

[11] Patent Number: 4,789,373

[45] Date of Patent: Dec. 6, 1988

[54] HYDRAULIC TORQUE IMPULSE GENERATOR

[75] Inventor: Nils G. Adman, Huddinge, Sweden

[73] Assignee: Atlas Copco Aktiebolag, Nacka, Sweden

[21] Appl. No.: 183,379

[22] Filed: Apr. 13, 1988

Related U.S. Application Data

[63] Continuation of Ser. No. 2,117, Jan. 12, 1987, abandoned.

[30] Foreign Application Priority Data

Jan. 23, 1986 [SE] Sweden ..... 8600281

[51] Int. Cl.[4] ..... B25D 15/00

[52] U.S. Cl. ..... 464/25; 277/176; 464/26

[58] Field of Search ..... 92/60; 277/173, 176, 277/177; 464/24, 25, 26

[56] References Cited

U.S. PATENT DOCUMENTS

| | | | |
|---|---|---|---|
| 2,842,336 | 7/1958 | Johnson | 277/173 X |
| 3,160,416 | 12/1964 | Ryffel | 277/173 X |
| 3,998,443 | 12/1976 | Webb | 464/26 X |
| 4,055,338 | 10/1977 | Dyer | 464/26 X |
| 4,175,408 | 11/1979 | Kasai et al. | 464/25 |
| 4,553,948 | 11/1985 | Tatsuno | 464/25 |

FOREIGN PATENT DOCUMENTS

| | | |
|---|---|---|
| 974781 | 11/1964 | United Kingdom . |
| 1002262 | 8/1965 | United Kingdom . |

*Primary Examiner*—Daniel P. Stodola

*Attorney, Agent, or Firm*—Frishauf, Holtz, Goodman & Woodward

[57] ABSTRACT

A hydraulic torque impulse generator comprises a motor rotated drive member (16) including a fluid chamber (18) into which the rear end portion (19) of an output spindle (21) extends to receive torque impulses generated in said fluid chamber (18). The rear end portion (19) of the output spindle (21) carries a radially sliding vane (23) for cooperation with the fluid chamber (18) such that a high pressure compartment and a low pressure compartment are accomplished during a limited portion of the relative rotation between the drive member (16) and the output spindle (21). A seal barrier (43–50) around the output spindle (21) prevents fluid leakage from the fluid chamber (18). The seal barrier comprises a clearance seal (43) between the fluid chamber end wall (38) and a low pressure area which is sealed off to the atmosphere by low pressure seal rings (47, 48, 60). A piston (46, 64) is arranged to compensate for temperature related volume changes in the hydraulic fluid, and to ensure a substantially constant nominal pressure within the fluid chamber (18).

4 Claims, 1 Drawing Sheet

HYDRAULIC TORQUE IMPULSE GENERATOR

This application is a continuation of application Ser. No. 002,117, filed Jan. 12, 1987 now abandoned.

BACKGROUND OF THE INVENTION

This invention relates to a hydraulic torque impulse generator of the type comprising a motor-rotated drive member including a hydraulic fluid chamber of a generally cylindrical shape, an output spindle having an impulse receiving rear portion extending into said fluid chamber through an opening in the forward end wall of the latter, a seal means associated with said drive member and said impulse receiving portion of said output spindle and arranged to divide said fluid chamber into at least one high pressure compartment and at least one low pressure compartment during a limited portion of the relative rotation between said drive member and said output spindle, and a seal barrier between said output spindle and said drive member for sealing off said fluid chamber from the atmosphere.

A problem concerned with hydraulic impulse generators of the above type is to accomplish an efficient fluid seal or barrier around the output spindle, a seal means which is able to withstand the very high pressure peaks generated in the fluid chamber during operation of the tool as well as the pressure fluctuations owing to temperature related volume changes in the hydraulic fluid.

The main object of the present invention is to accomplish a torque impulse generator of the above related type in which an improved fluid tight seal barrier is employed between the fluid chamber end wall and the output spindle, a seal barrier which is able to absorb temperature related volume changes in the hydraulic fluid and to ensure a substantially constant nominal pressure within the fluid chamber.

Further objects and advantages of the invention will appear from the following detailed description.

DETAILED DESCRIPTION

Figure 1:
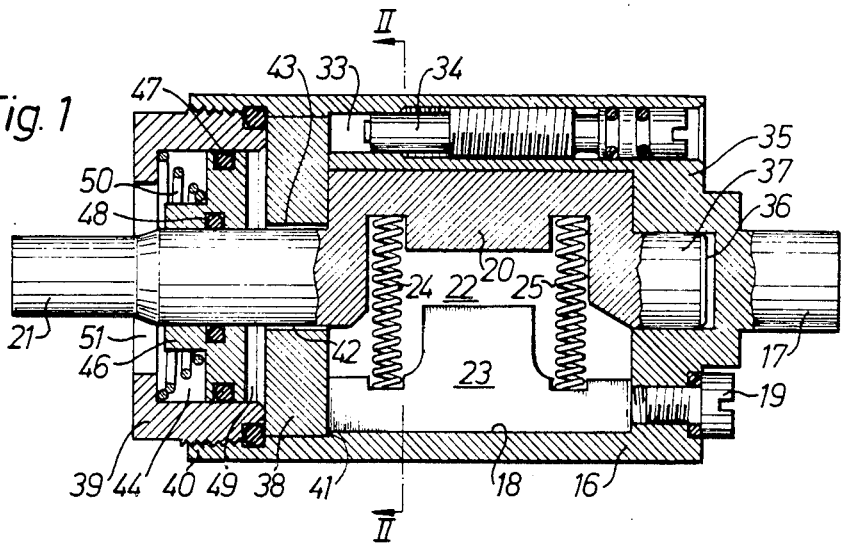
FIG. 1 shows a longitudinal section of a torque impulse generator according to one embodiment of the invention.

The torque impulse generator shown in the drawing comprises an drive member 16 which by a rear stub axle 17 is connectable to a rotation motor. The drive member 16 is hollow and comprises a cylindrical fluid chamber 18 in which is rotatably supported the rear end portion 20 of an output spindle 21. The output spindle 21 is connectable to a screw joint to be tightened via a chuck and nut socket attached to the output spindle 21. The rear end portion 20 of the output spindle 21 comprises a radial slot 22 in which is slidably supported a vane 23. Springs 24 and 25 are provided to urge the vane 23 radially outwards into contact with the inner wall of the fluid chamber 18. The fluid chamber 18 is filled with hydraulic fluid via plug 19.

Figure 2:
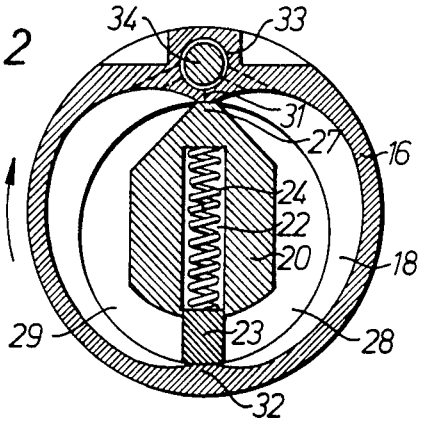
FIG. 2 shows a cross section along line II—II in FIG. 1.

The rear portion 20 of the output spindle 21 is formed with an axially extending ridge 27 which together with the vane 23 is arranged to sealingly divide the fluid chamber 18 into a high pressure compartment 28 and a low pressure compartment 29 when rotating the drive member 16 in the direction indicated by the arrow in FIG. 2. This division of the fluid chamber 18 occurs during a limited portion only of the relative rotation between the drive member 16 and the output spindle 21. See FIG. 2. The axial ridge 27 of the output spindle 21 cooperates with a seal portion 31 in the fluid chamber 18, and the vane 23 cooperates with another axially extending seal portion 32 disposed diametrically opposite seal portion 31.

In a bore 33 located in the drive member 16, in parallel with the output spindle 21, there is threadingly received an adjustment screw 34. As being illustrated by dotted lines in FIG. 2, the bore 33 communicates with the fluid chamber 18 on both sides of the seal portion 31 and serves as a bypass passage for hydraulic fluid during the time interval during which a pressure difference prevails between compartment 28 and compartment 29. The purpose of the adjustment screw 34 is to accomplish a variable restriction of that bypass passage and, thereby, to enable a setting of the maximum output torque of the tool.

According to the embodiment of the invention shown in FIG. 1 the fluid chamber 18 comprises a rear end wall 35 which is formed with a bottom hole 36 in which the rear end 37 of the output spindle 21 is journalled. Whereas the rear end wall 35 constitutes an integrated part of the drive member 16 the forward end wall 38 of the fluid chamber 18 is a separate element axially clamped against an annular shoulder 41 in the drive member 16 by a ring element 39. The latter is threadingly received in a socket portion 40 in the forward end of the drive member 16.

The forward end wall 38 is formed with a central opening 42 through which the output spindle 21 extends. A clearance seal 43 is formed in the opening 42 between the fluid chamber end wall 38 and the output spindle 21. In a cylinder bore 44 in the ring element 39 there is displaceably guided an annular piston 46. The latter carries on its outer periphery seal ring 47 for sealing engagement with the cylinder 44 and on its inner periphery a seal ring 48 for sealing engagement with the output spindle 21. The piston 46 forms together with the bore 44 and the end wall 38 a low pressure chamber 49 the volume of which is variable due to the axial movability of the piston 46. A spring 50 exerts a bias force on the piston 46 toward the end wall 38, thereby seeking to decrease the volume of chamber 49. A concentric aperture 51 in the ring element 39 connects the piston 46 to the atmosphere.

During operation of the tool the relative rotation between the drive member 16 and the output spindle 21 results in repeated pressure peaks of short duration in the high pressure compartment 28. This occurs each time the seal portions 27 and 31, of the output spindle 21 and the drive member 16, respectively, and the vane 23 and seal portion 32 interact. The size of the clearance seal 43 between the output spindle 21 and the end wall opening 42 is small enough to prevent the pressure peaks generated in the fluid chamber 18 from reaching the low pressure chamber 49. The latter is reached only by the hydraulic fluid which due to a temperature related increase of the fluid volume is slowly pressed through the clearance seal. The nominal fluid pressure, i.e. pressure other than torque pulse generating pressure peaks, is determined by the spring 50. The latter is preferably not stronger than what is needed to overcome the frictional resistance of the piston seal rings 47 and 48. This means that the fluid pressure acting on the piston seal rings 47 and 48 is very low and that seal rings of any conventional standard type may be used. The actual size of the low pressure chamber 49 is determined by the actual volume of the hydraulic fluid, which in turn depends on the amount of fluid with which the fluid chamber 18 was originally filled via plug 19 and on the actual temperature of the fluid. After some time of operation, the hydraulic fluid gets hot and expands. The surplus fluid pours out through clearance seal 43 and causes the piston 46 to move away from end wall 38. The only growth in pressure is due to the further compression of spring 50 and does not increase the risk for leakage.

As the fluid is cooled down after completed operation the fluid volume decreases, which means that fluid starts pouring back through the clearance seal 43 into the fluid chamber 18, continuously backed up by the spring biassed piston 46 in the low pressure chamber 49.

Figure 3:
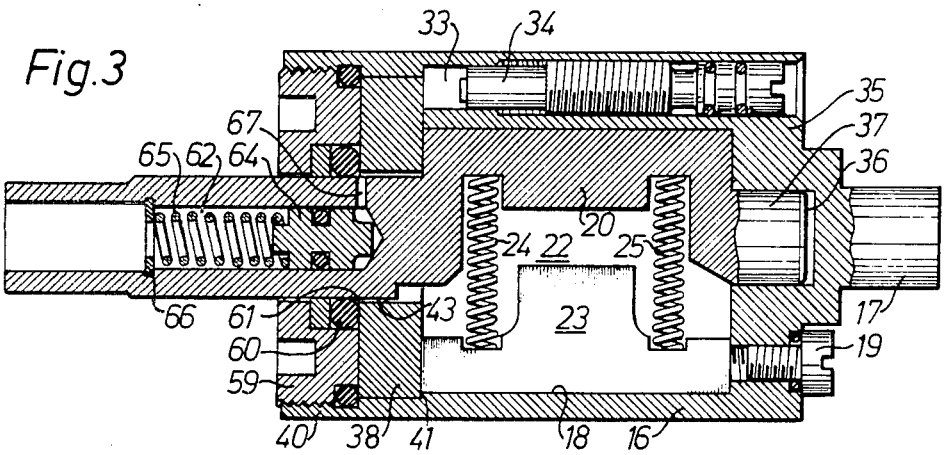
FIG. 3 shows a longitudinal section of a torque impulse generator according to another embodiment of the invention.

In the embodiment of the invention shown in FIG. 3, the forward end wall 38 of the fluid chamber 18 is axially clamped against the shoulder 41 by means of a flat ring plug 59. The latter cooperates threadingly with socket portion 40 in the drive member 16 and supports a seal ring 60 which cooperates with the output spindle 21.

A small annular low pressure chamber 61 is formed between end wall 38 and the seal ring 60. As in the above described embodiment the clearance seal 43 between the wall 38 and the output spindle 21 prevents the high pressure peaks developed in the fluid chamber 18 from reaching the area outside the wall 38. In an open ended axial bore 62 in the output spindle 21 there is movably guided a piston 64, and a compression spring 65 supported by a lock ring 66 is arranged to exert a bias force on the piston 64 toward the inner end of the bore 62. A radial passage 67 connects the inner end of the bore 62 to the low pressure chamber 61. The chamber 61 forms together with the radial passage 67 and the inner part of the bore 62 a low pressure area the volume of which is determined by the position of the piston 64.

In operation, the impulse generator shown in FIG. 3 produces torque impulses in the same way as the above described embodiment. At volume changes in the hydraulic fluid a very restricted fluid communication through clearance seal 43 ensures that the nominal fluid pressure within the fluid chamber 18 remains substantially constant. The variations in fluid volume are compensated for by the adjustability of the piston 64 which via the radial passage 67 continuously communicates with the small annular chamber 61 outside the clearance seal 43. The piston 64 is balanced between the fluid pressure on its right hand side in FIG. 3 and the atmospheric pressure and the spring 65 on its left hand side. The nominal fluid pressure never exceeds the pressure generated by the spring 65 on the piston 64.

I claim:

1. Hydraulic torque impulse generator, comprising:

a motor-rotated drive member (16) including a hydraulic fluid chamber (18) of a generally cylindrical shape;

an output spindle (21) having an impulse receiving rear portion (20) extending into said fluid chamber (18) through an opening (42) in the forward end wall (38) of said fluid chamber (18);

seal means (23, 32, 27, 31) associated with said drive member (16) and said impulse receiving portion (20) of said output spindle (21) and arranged to divide said fluid chamber (18) into at least one high pressure compartment (28) and at least one low pressure compartment (29) during a limited portion of a relative rotation between said drive member (16) and said output spindle (21), thereby producing transient torque impulse generating pressure peaks in said at least one high pressure compartment (28); and a seal barrier between said output spindle (21) and said drive member (16) for sealing off said fluid chamber (18) from the atmosphere;

said seal barrier comprising:

a substantially nonresilient clearance seal means (43) defined by said output spindle (21) and said fluid chamber end wall (38) for preventing said transient pressure peaks from propagating outside said fluid chamber (18);

a low pressure area (49; 61, 62, 67) defined outside of said fluid chamber (18) and communicating with said fluid chamber (18) through said clearance seal means (43); and a yieldable partition means (46, 64) partly defining said low pressure area (49; 61, 62, 67) and communicating on one side thereof with said low pressure area (49; 61, 62, 67) and on the other side thereof with the atmosphere, said partition means (46, 64) being arranged to produce volume charges of said low pressure area (49; 61, 62, 67) in relation to occurring volume changes in the hydraulic fluid during operation of the hydraulic torque impulse generator.

2. Impulse generator according to claim 1, wherein said low pressure area (49) comprises a cylinder bore (44) which concentrically surrounds said output spindle (21), said yieldable partition means (46) comprises an annular piston which is movably guided in said cylinder bore (44), and which includes at least one seal ring (47) at its outer periphery for cooperation with said cylinder bore (44) and at least one seal ring (48) at its inner periphery for cooperation with said output spindle (21).

3. Impulse generator according to claim 2, comprising a spring means (50) for biasing said annular piston (46) toward a decreasing volume of said low pressure area (49).

4. Impulse generator according to claim 1, wherein said low pressure area (61, 62, 67) comprises a cylinder bore (62) which is located within and extends coaxially with said output spindle (21), and a radially extending passage (67) connecting said cylinder bore (62) to the outside of said output spindle (21), said yieldable partition means comprising a piston (64) which is sealingly guided in said cylinder bore (62) and biassed by a spring means (65) toward said low pressure area (61, 62, 67).

* * * * *

UNITED STATES PATENT AND TRADEMARK OFFICE

CERTIFICATE OF CORRECTION

PATENT NO. : 4,789,373

DATED : Dec. 6, 1988

INVENTOR(S) : ADMAN

It is certified that error appears in the above-identified patent and that said Letters Patent is hereby corrected as shown below:

Title page, right-hand column, under "Foreign Patent Documents" change "97481" to read --974751--.

Signed and Sealed this

Twenty-sixth Day of December, 1989

*Attest:*

JEFFREY M. SAMUELS

*Attesting Officer* *Acting Commissioner of Patents and Trademarks*